US007812812B2

(12) United States Patent
Yoshinaga et al.

(10) Patent No.: US 7,812,812 B2
(45) Date of Patent: Oct. 12, 2010

(54) DRIVING METHOD OF DISPLAY APPARATUS

(75) Inventors: Hideki Yoshinaga, Yokohama (JP); Hideo Mori, Yokohama (JP); Tatsuhito Goden, Kawasaki (JP); Noriyuki Shikina, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 280 days.

(21) Appl. No.: 10/529,906

(22) PCT Filed: Mar. 24, 2004

(86) PCT No.: PCT/JP2004/004042

§ 371 (c)(1),
(2), (4) Date: Feb. 9, 2006

(87) PCT Pub. No.: WO2004/086348

PCT Pub. Date: Oct. 7, 2004

(65) Prior Publication Data

US 2006/0187185 A1 Aug. 24, 2006

(30) Foreign Application Priority Data

Mar. 25, 2003 (JP) ..... 2003-083716
Jun. 9, 2003 (JP) ..... 2003-164079

(51) Int. Cl.
*G09G 3/34* (2006.01)

(52) U.S. Cl. ..... 345/107; 359/296

(58) Field of Classification Search ..... 345/107, 345/433, 619, 179; 257/499; 340/712; 359/296
See application file for complete search history.

(56) References Cited

U.S. PATENT DOCUMENTS

| | | | | |
|---|---|---|---|---|
| 3,612,758 | A | 10/1971 | Evans et al. | 178/5.4 R |
| 5,194,852 | A * | 3/1993 | More et al. | 345/182 |
| 5,508,720 | A | 4/1996 | DiSanto et al. | 345/169 |
| 5,912,654 | A | 6/1999 | Ouchi et al. | 345/98 |
| 6,020,895 | A * | 2/2000 | Azami | 345/619 |
| 6,067,645 | A | 5/2000 | Yamamoto et al. | 714/57 |
| 6,078,318 | A | 6/2000 | Mori et al. | 345/204 |
| 6,188,378 | B1 | 2/2001 | Yamamoto et al. | 345/101 |
| 6,335,720 | B1 | 1/2002 | Mori et al. | 345/98 |

(Continued)

FOREIGN PATENT DOCUMENTS

| | | |
|---|---|---|
| JP | 5-100645 | 4/1993 |

(Continued)

*Primary Examiner*—Amare Mengistu
*Assistant Examiner*—Yuk Chow
(74) *Attorney, Agent, or Firm*—Fitzpatrick, Cella, Harper & Scinto

(57) ABSTRACT

A display device is driven by a driving method including a first drawing step of displaying an image by controlling a display medium on the basis of a first image signal, and a second drawing step of overwriting a handwritten image on the displayed image by controlling the display medium on the basis of a second image signal. In the first drawing step, an image is drawn by a reset drive for resetting a previous display image and a writing drive for writing an image, and in the second drawing step, the writing drive of a minimum or a substantially maximum luminance is performed without effecting the reset drive only in an area in which the hand-written image is written.

6 Claims, 10 Drawing Sheets

U.S. PATENT DOCUMENTS

| | | | | |
|---|---|---|---|---|
| 6,348,910 | B1 | 2/2002 | Yamamoto et al. | 345/102 |
| 6,504,524 | B1 * | 1/2003 | Gates et al. | 345/107 |
| 6,563,512 | B1 * | 5/2003 | Azami et al. | 345/619 |
| 6,680,517 | B2 * | 1/2004 | Namba | 257/499 |
| 6,762,744 | B2 | 7/2004 | Katase | 345/107 |
| 6,961,047 | B2 | 11/2005 | Katase | 345/107 |
| 2001/0030639 | A1 | 10/2001 | Goden | 345/107 |
| 2002/0005832 | A1 * | 1/2002 | Katase | 345/107 |
| 2004/0085301 | A1 * | 5/2004 | Furukawa et al. | 345/179 |

FOREIGN PATENT DOCUMENTS

| | | |
|---|---|---|
| JP | 5-324163 | 12/1993 |
| JP | 9-211499 | 8/1997 |
| JP | 2001-142425 | 5/2001 |
| JP | 2002-116734 | 4/2002 |
| JP | 2002-297089 | 10/2002 |
| JP | 2003-032588 | 1/2003 |
| WO | WO 03/100515 | 12/2003 |

* cited by examiner

DRIVING METHOD OF DISPLAY APPARATUS

TECHNICAL FIELD

The present invention relates to a driving method of a display device capable of displaying an image by controlling distribution of electrophoretic particles (charged particles) and capable of effecting writing of an additional handwritten image such as a line image or a character image to an image, such as a gradation image.

BACKGROUND ART

With development of information equipment, the needs for low-power and thin display apparatuses have grown, so that extensive study and development have been made on display apparatus fitted to these needs. Such display apparatuses includes a display device which permits handwriting input of graphic and character images while effecting pressing with a pen (stylus) or finger without using a keyboard (hereinafter, this function is referred to as a "pen input function") in view of use in outdoors, power saving and spacing saving. This display device is used in a wearable PC (personal computer), an electronic note pad, etc.

A liquid crystal display device is known as the display device but has been accompanied with problems when it is provided with a pen input function. More specifically, most of liquid crystals have no memory characteristic, so that it is necessary to continuously apply a voltage during display (input of graphic or characters), thus resulting in an increase in power consumption. On the other hand, with respect to liquid crystals having a memory characteristic, it is difficult to ensure reliability on the assumption that the resultant liquid crystal device is used in various environments as in the wearable PC. As a result, it is difficult to commercialize the liquid crystal device.

As another type of a display apparatus having a memory characteristic and of a low-power and thin type, an electrophoretic display apparatus has been proposed by Harold D. Lee et al. (U.S. Pat. No. 3,612,758).

This type of electrophoretic display apparatus includes a pair of substrates disposed with a predetermined spacing, an insulating liquid filled in the spacing between the substrates, a multiplicity of colored charged migration particles (electrophoretic particles) dispersed in the insulating liquid, and an upper electrode (disposed on a viewer side substrate) and a lower electrode (disposed on a rear substrate) which are disposed along the respective substrates at each pixel. The electrophoretic particles are electrically charged positively or negatively, so that they are adsorbed by the upper electrode or the lower electrode depending on a polarity of a voltage applied to these electrodes. As a result, it is possible to display an image by utilizing a state in which the electrophoretic particles are adsorbed by the upper electrode and are observed from a viewer side and a state in which the electrophoretic particles are adsorbed by the lower electrode so that the color of the insulating liquid is visually identified. This type of the electrophoretic display apparatus is referred to as a vertical movement type electrophoretic display apparatus.

On the other hand, Japanese Laid-Open Patent Application (JP-A) No. Hei 9-211499 has disclosed a horizontal movement type electrophoretic display apparatus. This type of electrophoretic display apparatus, different from the vertical movement type electrophoretic display apparatus including the upper and lower electrodes disposed to sandwich the insulating liquid, includes electrodes 13*a* and 13*b* which are disposed along one substrate 10*b* so as to move electrophoretic particle 12 in a direction along the substrate 10*b* as described in detail later with reference to FIG. 6. The horizontal movement type electrophoretic display apparatus displays an image by utilizing a difference in color between a dispersion state of the electrophoretic particles in a broad area and an accumulation (collection) state of the electrophoretic particles in a narrow area while using a transparent insulating liquid 11.

As a device capable of inputting graphics and characters while applying pressure with a pen or finger. JP-A Hei 5-324163 has proposed a resistance film type coordinate position detection device. By using the electrophoretic display apparatus and such a detection device in combination, it becomes possible to realize a paper like display which, e.g., permits the wearable PC of power and space saving type and can take notes.

In a conventional display device having the pen input function, when pen input is performed, a position coordinate of the pen is detected and written over an image which has already been stored in a display memory. Thereafter, similarly in an ordinary display, data is read from the display memory frame by frame and is sent to a display panel. As a result, the image overwritten with the pen is displayed on a display picture area (screen).

Incidentally, in an ordinary electrophoretic display apparatus having no pen input function, such a driving method wherein a reset drive is performed before effecting an image writing drive has generally been used. More specifically, a display state is once reset to white or black. This is because it is necessary to erase a previously displayed image in order to display a fresh image since the electrophoretic display apparatus has a memory characteristic. The rewriting with resetting includes a case where it is performed by separating reset scanning and writing scanning on a field basis and a case where it is performed by continuously effecting resetting and writing on a line basis.

The electrophoretic display (apparatus) has a relatively slow display response to voltage application when compared with CRTs (cathode-ray tubes) and liquid crystal displays, so that it is used principally for displaying a still image, e.g., in an electronic book or previous display. For these purposes, the entire picture area is ordinarily rewritten on a page basis, so that a resultant image can be viewed with less inconformity even when the picture area is once reset to pure white or solid black.

However, even for the purpose of still image display, at the time of pen-based input, rewriting operation frequently occurs in order to reproduce a trail of a pen as fast as possible. If the frequency of rewriting operation is low, the trail of the pen is displayed late on the picture area even when the pen is moved on the picture area, so that a user feels a considerable inconformity. Accordingly, the display apparatus is required to have a moving image-level rewriting frequency at the time of pen input. However, in the case of performing the above-described driving method using the reset drive and the writing drive, the reset state is visually identified flickeringly. As a result, a display quality is lowered. This flickering is particularly noticeable in the electrophoretic display since it has a low response speed. Even if a so-called partial rewriting operation for scanning only a rewritten portion is performed in order to promote reflectance of the pen input in display, it is no different from the fact that the reset state is visible to eyes.

Further, when the position coordinate of the pen input is overwritten in a display memory, information on the trail of the pen is stored partially, i.e., so-called on a piecemeal basis, in a certain rewriting cycle since the rewriting cycle of the display memory is previously determined. Accordingly, display of the pen trail is also performed on a piecemeal basis, so that a line or a character inputted with the pen is not displayed as the pen is moved. The user also feels inconformity with respect to this phenomenon.

In some cases, such an "undo" function that only an additional image written with a pen or the like is erased so that the display state is returned to a previous state before writing of the additional image is added to the display apparatus, but when a reset drive is performed in such cases, flickering is caused to occur, thus lowering a display quality.

DISCLOSURE OF THE INVENTION

An object of the present invention is to provide a driving method of an electrophoretic display apparatus which alleviates a lowering in display quality and inconformity felt by a user in the case of effecting pen-based input as described above.

Another object of the present invention is to provide such an electrophoretic display apparatus.

According to the present invention, there is provided a driving method of a display apparatus, comprising:

a first drawing step of displaying an image by controlling a display medium on the basis of a signal from first image creation means, and a second drawing step of overwriting a handwritten image, such as an additional line or character image on the displayed image by controlling the display medium on the basis of a signal from second image display means, wherein in the first drawing step, an image is rewritten by a reset drive for resetting a display state and a writing drive for writing an image, and in the second drawing step, the writing drive is performed without effecting the reset drive.

According to the present invention, there is also provided a display apparatus, which permits handwriting input and has a memory characteristic, comprising:

detection means for detecting handwriting input, and drive means for effecting a first drive in which an image is rewritten by applying a writing voltage after resetting a previous display image when the handwriting input is not detected, and a second drive in which a previous display image is overwritten with a handwriting image by applying only a writing voltage without effecting resetting when the handwriting input is detected.

By the driving method of electrophoretic display apparatus of the present invention, in the second drawing step, the writing drive is performed but substantially no reset drive is performed, so that a handwritten image (e.g., an additionally written line or character image) is displayed of good quality without causing a broken image.

Further, in the case of effecting a drive for erasing an additional image while leaving only a gradation image, no flickering or the like is not caused to occur. As a result, it is possible to avoid a lowering in display quality.

BEST MODE FOR CARRYING OUT THE INVENTION

Figure 3:
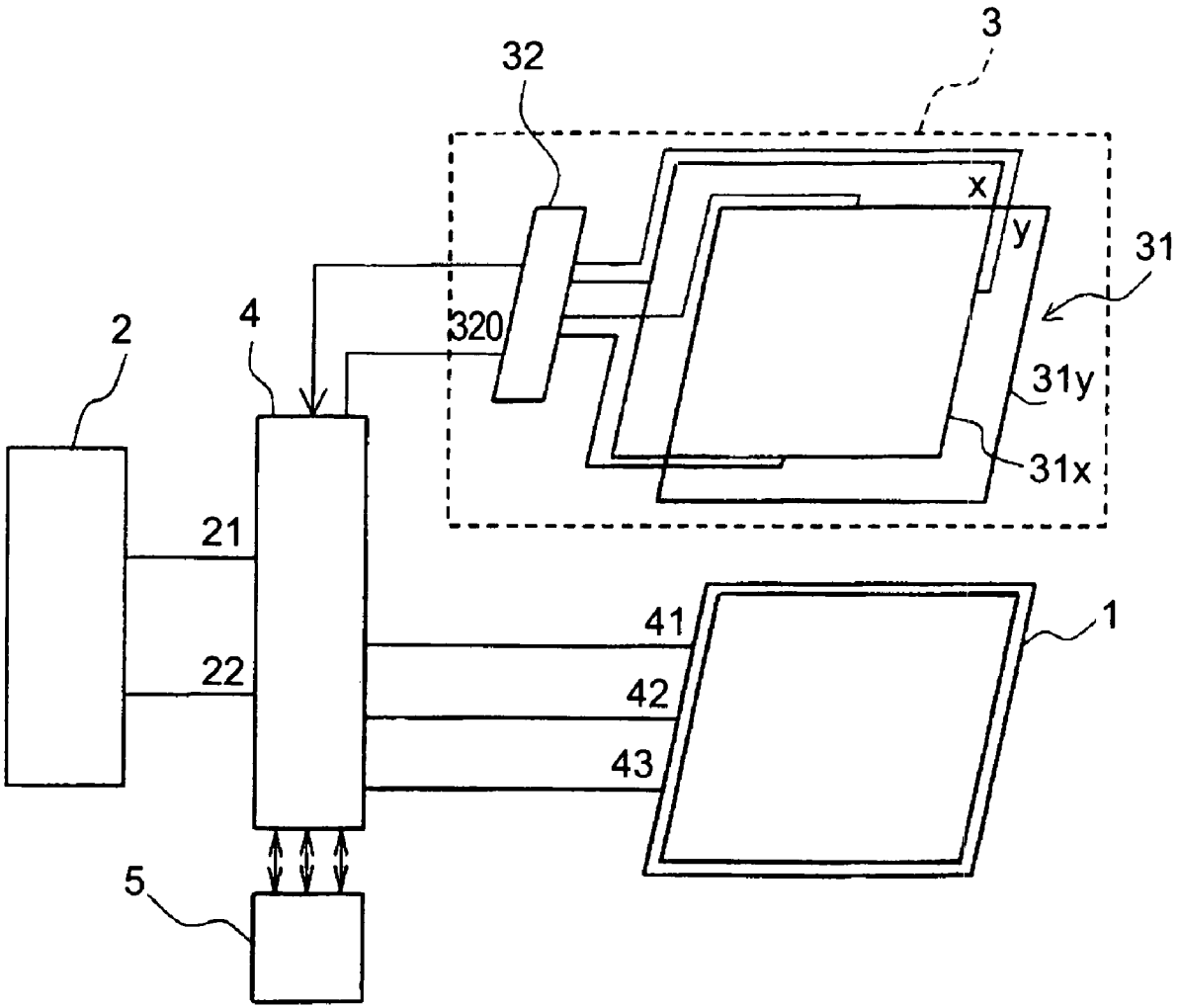
FIG. 3 is a block diagram showing a structure of the electrophoretic display apparatus of the present invention.

FIG. 3 is a schematic view of the display apparatus according to the present invention.

Referring to FIG. 3, a display panel 1 receives display image data from both of a first image creation means 2 and a second image creation means 3 and effects display through a control unit (controller) 4.

Figure 4:
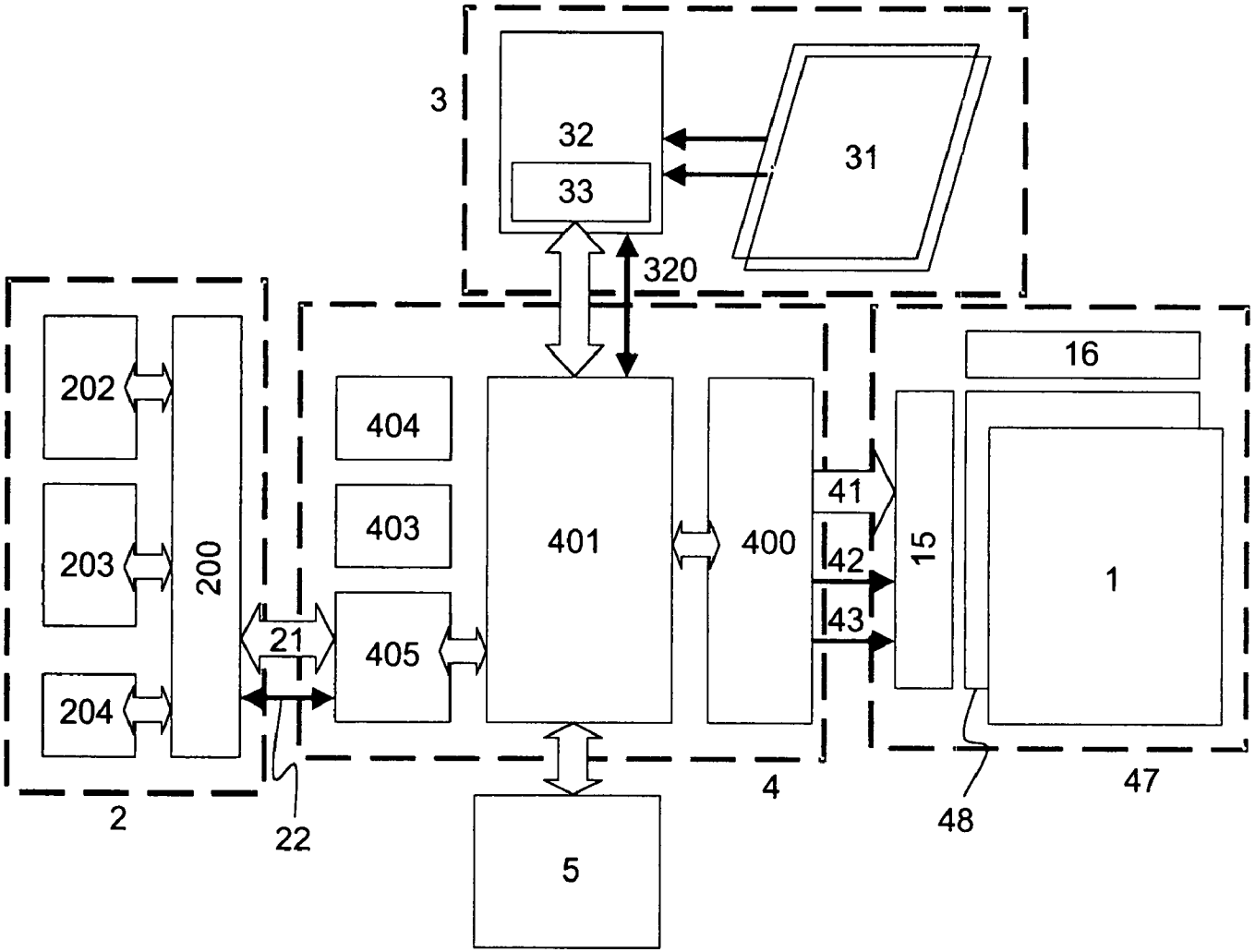
FIG. 4 is a block diagram showing a detailed structure of the electrophoretic display apparatus of the present invention.

FIG. 4 is a block diagram showing a detailed structure of respective structural members shown in FIG. 3.

The display panel 1 constitutes a display module 47 together with a TFT (thin film transistor) backplane 46, a scanning line drive circuit 15, and a data line drive circuit 16.

The first image creation means 2 is a circuit block having a function of displaying a previously memorized image or an externally given image on the display panel (display device) 1. As shown in FIG. 4, the circuit block includes an internal memory for storing an image (SRAM) 201, an external memory (flash ROM) 202, a communication interface circuit 203 which receives an external image signal, and a buffer circuit 200 for transmitting these signals to the controller 4.

The second image creation means 3 is a circuit block having a function of displaying a pen input image drawn by a user on the display panel 1. The circuit block includes a digitizer 31 (comprising X-coordinate detection sheet 31*x* and Y-coordinate detection sheet 31*y*) for detecting a position pressed with a pen (stylus) or finger, a memory 33 for storing a signal from the digitizer 31, and a digitizer controller 32 for outputting the memorized coordinate position as an image signal.

The controller 4 includes a panel controller 400, a graphic controller 401, a CPU 403, a power management 404, an external memory control circuit 405, etc.

The graphic controller feeds information to be displayed on the display panel 1 on the basis of information preliminarily stored in the internal memory 201 and those on, e.g., the coordinate position sent from the external memory 202, the communication interface circuit 203 or the digitizer controller 32, to a video RAM (VRAM) 5, and transfers image data and control signals in formats required for driving the display panel 1 on the basis of information in the VRAM 5 to the display module 47 through the panel controller 400.

In the display module 47, the image data outputted from the panel controller 400 and the control signals such as Vsync and Hsync are received, and desired voltages are applied from the scanning line drive circuit 15 and the data line drive circuit 16 to the TFT backplane 48 to effect display at each pixel of the display panel 1.

As described later in detail, this type of electrophoretic display apparatus not only can display a pen-based input image, such as a handwritten character, on the display panel based on information obtained from the second image creation means 3 but also can overwrite a displayed gradation image with a line, character or the like obtained from the second image creation means 3 by displaying the gradation image on the display panel based on information stored in advance in the first image creation means 2.

As the display panel 1, an electrophoretic display panel having an active matrix structure is representatively used.

Figure 5:
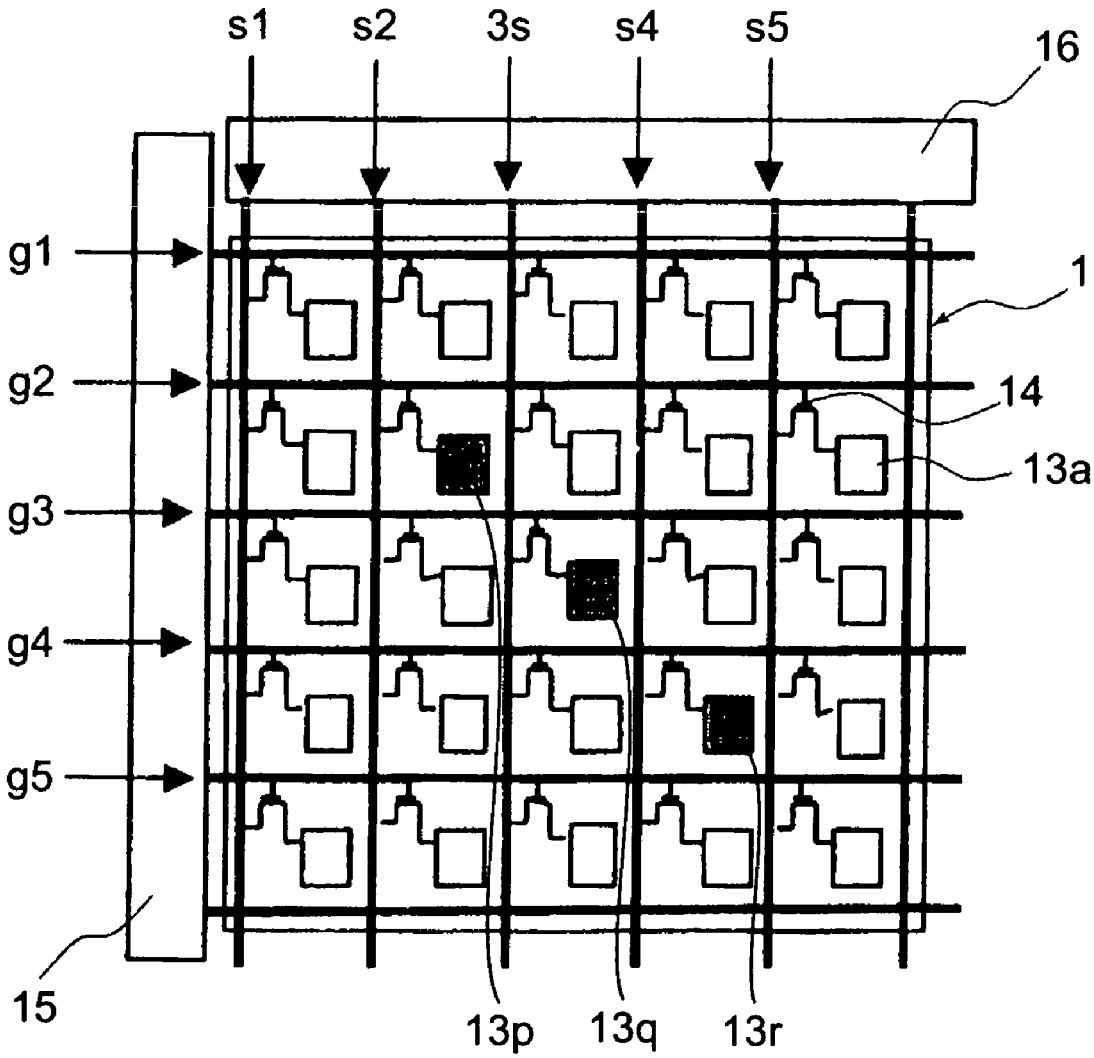
FIG. 5 is a circuit diagram showing a structure of an electrophoretic display panel.

FIG. 5 illustrates a schematic view of the display panel 1 and the drive circuit blocks 15 and 16 disposed at a periphery of the display panel 1. The display panel 1 includes, as will be described later, two substrates 10*a* and 10*b* (FIGS. 6(*a*) and 6(*b*)) of which the substrate 10*b* is provided with gate signal lines g1, g2, . . . , and source signal lines s1, s2, . . . , which intersect at right angles and further provided with a TFT 14 (as a switching element) and a pixel electrode 13*a* at an intersection of the gate and source signal lines. Each of the TFT 14 has a gate electrode connected to an associated gate signal line g1, g2, . . . , a source electrode connected to an associated source signal line s1, s2, . . . , and a drain electrode connected to the pixel electrode 13.

At the periphery of the electrophoretic display panel 1, the scanning line drive circuit (scanning driver) 15 for driving the gate signal lines and the data signal lien drive circuit (data driver) 16 for driving the source signal lines. The scanning driver 15 is connected to the gate electrodes g1, g2, . . . , and the data driver 16 is connected to the source electrodes s1, s2, . . . .

Figure 6:
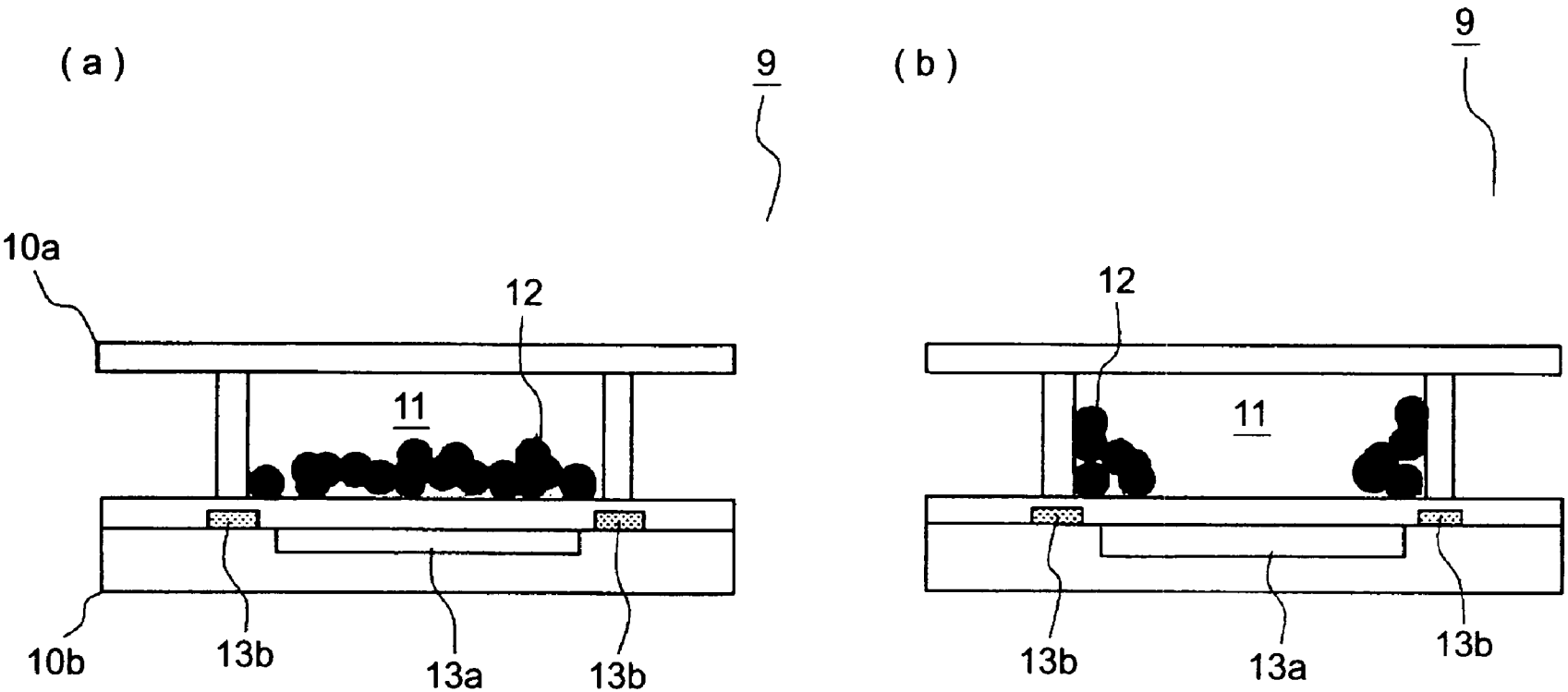
FIGS. 6(*a*) and 6(*b*) are respectively a sectional view of an electrophoretic display device.

A representative structure of the electrophoretic display device is shown in FIGS. 6(*a*) and 6(*b*).

The display panel 1 is constituted by two-dimensionally arranging a plurality of electrophoretic display devices 9 each shown in FIG. 6 in a state shown in FIG. 5.

As shown in FIGS. 6(*a*) and 6(*b*), the electrophoretic display device 9 includes a pair of substrates 10*a* and 10*b* disposed with a spacing and electrophoretic particles 12 and an insulating liquid 11 which are filled in the spacing. On one substrate 10*b*, an electrode 13 is disposed at each pixel and is connected to the switching element 14 (not shown in FIG. 6 but shown in FIG. 5). At a pixel boundary portion, a common electrode 13*b* is disposed. By applying an electric field between the pixel electrode 13*a* and the common electrode 13*b*, the electrophoretic particles 12 ar moved between a visually black (dark) state due to the color of the electrophoretic particles (FIG. 6(*a*)) and a visually white (bright) state due to light reflected from the substrate, thus being placed in a dark or bright display state.

Figure 7:
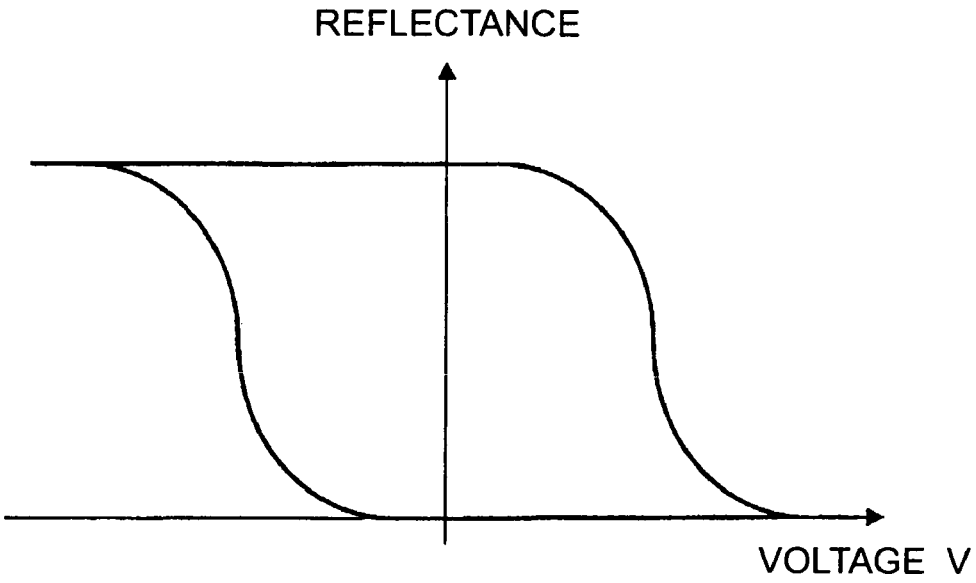
FIG. 7 is a graph showing an embodiment of a voltage-optical response (reflectance) characteristic of the electrophoretic display device.

A voltage-optical response (reflectance) characteristic of the electrophoretic display device 9 is shown in FIG. 7, which shows a characteristic of a display device having a memory characteristic. Referring to FIG. 7, when the electrophoretic particles are placed in the darkest state under no voltage application (at 0 V), this state is not changed under application of a positive-polarity voltage but is changed to a bright state at a certain voltage of a negative polarity. Even when the applied voltage is returned to 0 V after the display state is changed to the bright state, the resultant state is not returned to the darkest state but is kept in the bright state. This characteristic is the memory characteristic. When a position-polarity voltage is applied to the device in the bright state, the display state is changed to the dark state. Thereafter, when the applied voltage is returned to 0 V, the dark state is retained.

Figure 8:
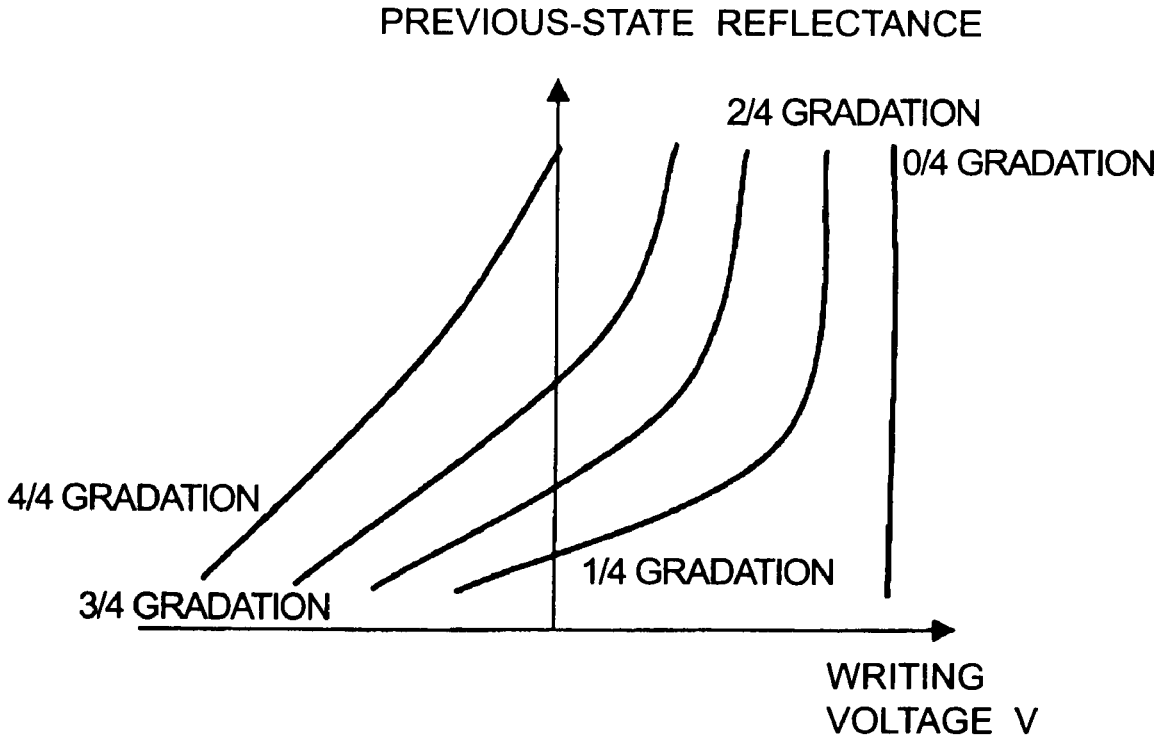
FIG. 8 is a graph showing a previous state dependence of an electrophoretic display apparatus.

FIG. 8 is a graph showing a previous (display) state of the electrophoretic display apparatus. More specifically, FIG. 8 illustrates a relationship between a previous state reflectance and a writing voltage required for displaying predetermined gradation levels (i.e., 0/4 gradation, 1/4 gradation, 2/4 gradation, 3/4 gradation, and 4/4 gradation). FIG. 8 shows that the writing voltage should be changed depending on a previous state reflectance even when an identical gradation level is intended to be displayed, i.e., that a different reflectance is obtained even if an identical voltage is applied. From the results shown in FIG. 8, it is understood that it is necessary to keep the previous state reflectance at a constant value by the reset drive so as not to change the relationship between the writing gradation level and the writing voltage. Accordingly, in this embodiment, in a first drawing step for displaying a fresh image, the rest drive is performed.

First Embodiment

Figure 1:
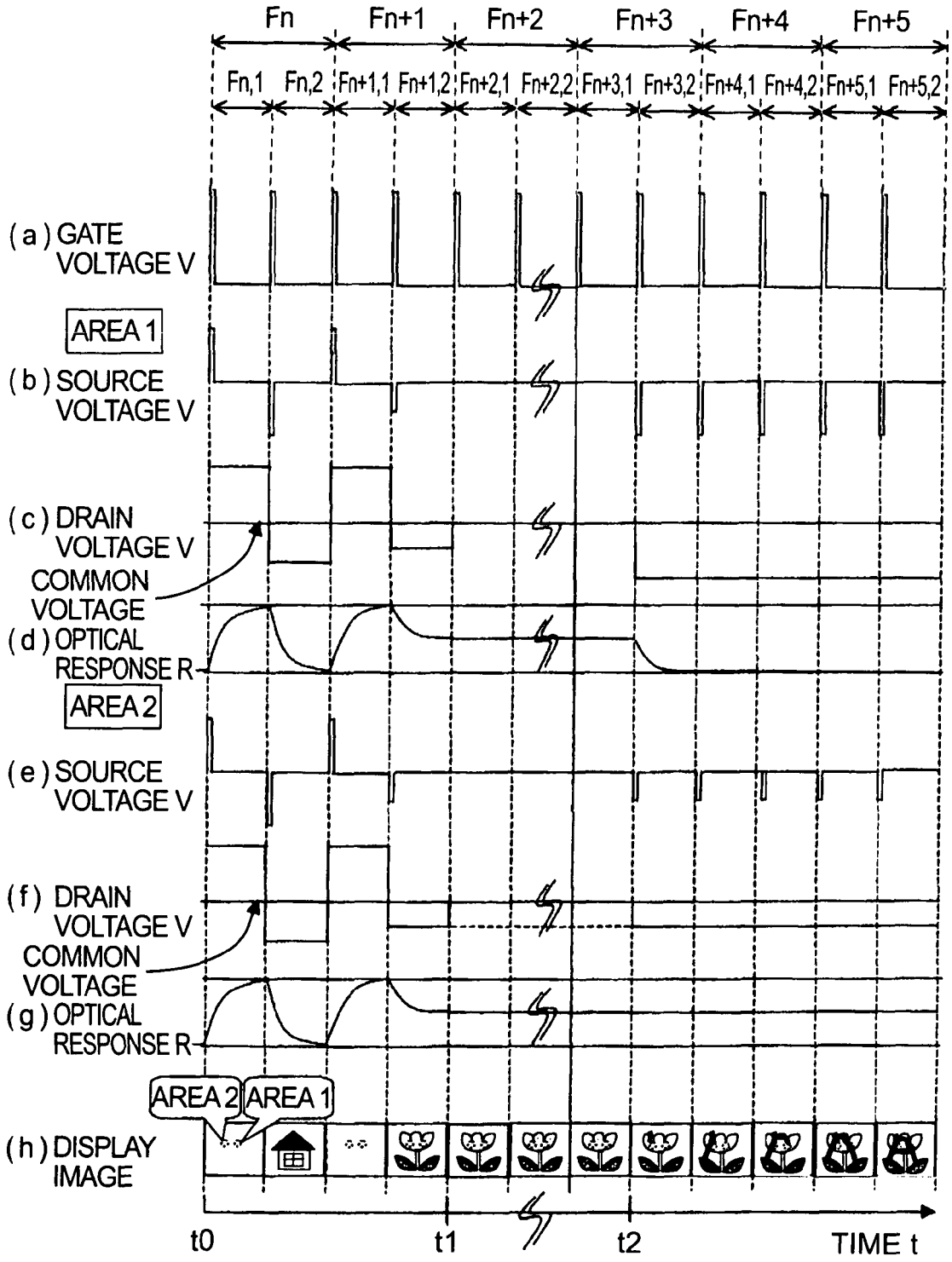
FIG. 1 is a waveform diagram for explaining the driving method of an electrophoretic display apparatus according to the present invention.

FIG. 1 is a drive waveform used in this embodiment according to the driving method of electrophoretic display apparatus of the present invention.

FIG. 1 shows a gate voltage at each pixel (a voltage applied to a gate electrode disposed at each pixel) at (a), a source voltage in an "area 1" shown at (h) (a voltage applied to a source electrode disposed at a pixel corresponding to the "area 1") at (b), a corresponding drain voltage (a voltage applied to the pixel electrode 13*a*) at (c), an optical response in the "area 1" at (d), corresponding voltages or optical response in an "area 2", shown at (h), at (e) to (d), and a display image at (h).

The display apparatus of the present invention effects display by using a driving method including separated three steps different in driving (operation) manners.

(1) First Drawing Step

In this step, image display is performed by a signal from the first image creation means 2. This drawing step is performed in a period from a time t0 to a time t1 shown at (h) of FIG. 1. When rewriting of display is effected, resetting is performed prior to writing of a fresh image.

(2) Memory Display Step

In this step, the finally written image is retained by a memory characteristic of the display panel. This memory display step is performed in a period from the time t1 to a time t2 shown at (h). A signal input is terminated at the time t1 and the display state at the time t1 is maintained during the period from the time t1 to that time t2.

(3) Second Drawing Step

In this step, an image is drawn on the display panel with the use of the digitizer 31 and a dedicated pen (stylus) 34, or the displayed image is overwritten with a line or a character. This second drawing step is performed in a period of the time t2 or later.

Drive in the first drawing step (1) will be described more specifically.

In the first drawing step, an image signal 21 and a clock (CLK) signal 22 are inputted from the first image creation means 2 to the controller 4 through signal lines 21 and 22. In the controller 4, an image correction such as γ correction is made with respect to the inputted image signal 21. For example, when each color information is 8 bits, 24 bit image data 41 corresponding to red, green and blue (8 bits×3) at each pixel is serially outputted successively. Further, on the basis of the inputted CLK signal 22, a synchronizing signal V-sync 42 is produced and outputted to the electrophoretic display panel 1. The inputted signal 21 is sent to the digitizer controller 22 as it is, as an output 320.

In the electrophoretic display panel 1, a drive waveform based on the serial image data and the synchronizing signal V-sync inputted from the input terminals 41 and 42 is outputted from the scanning drive 15 and the data driver 16, thus applying a gate voltage and a source voltage to the TFT 14 at each pixel.

Figure 2:
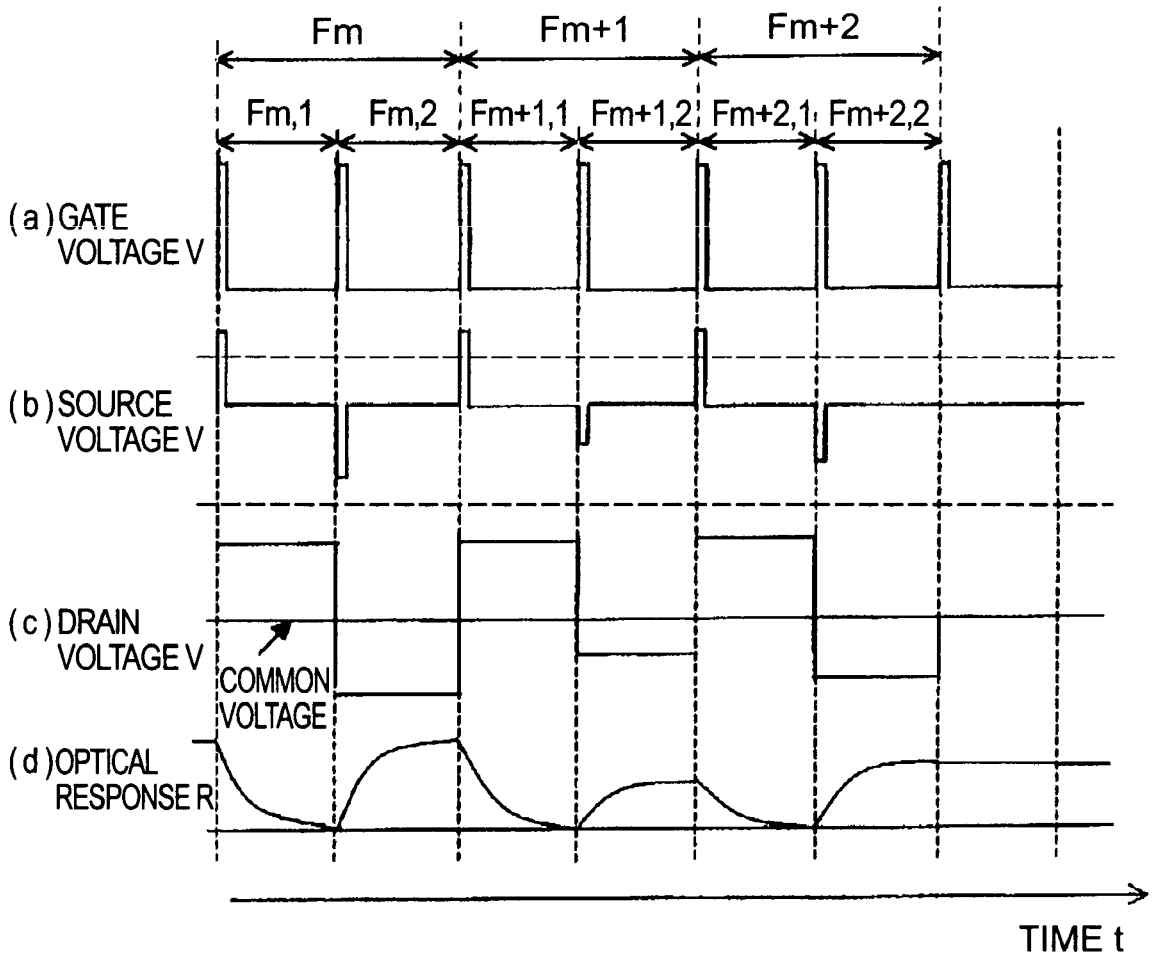
FIG. 2 is a waveform diagram for explaining an embodiment of a first drawing step.

FIG. 2 is a time chart showing timing of voltage application in the first drawing step, wherein (a) shows a scanning signal voltage (gate voltage), (b) shows a data signal voltage (source voltage), (c) shows a drawing voltage, and (d) shows an optical response at an associated pixel.

One frame period Fm (m=1, 2, 3, . . . ) is divided into two field periods including a former field period Fm, 1 and a latter field period Fm, 2. In the respective former field periods Fm, 1, Fm+1, 1, . . . , image resetting is performed, and in the respective later field periods Fm, 2, Fm+1, 2, image writing is performed.

In a specific example, the gate voltage has an ON voltage of +20 V, and OFF voltage of −20 V, and a frame rate of 15 Hz (at (1) of FIG. 2). Further, the source voltage has a reset voltage of +15 V and a writing voltage which can be changed in a range of 0 V to −15 V (at (b) of FIG. 2). The common electrode voltage is substantially 0 V. However, even when the source voltage is 0 V, in most cases, the drawing voltage does not become 0 V by the influence of feed through, so that the common electrode voltage is adjusted so as not to cause a potential difference between the pixel electrode and the common electrode when the source voltage is 0 V.

FIG. 2(*c*) shows a drain electrode potential, i.e., a pixel electrode potential.

In reset periods (the former field periods Fm, 1, Fm+1, 1, . . . ), a voltage of −15 V is applied to the drain electrode through the source electrode, and the common voltage is 0 V, so that the electrophoretic particles at an associated pixel are attracted toward the common electrode 13*b* side. As a result, while writing is performed and the pixel is placed in a reset state as shown in FIG. 6(*b*).

In writing periods (the latter field periods Fm, 2, Fm+1, 2, . . . ), a writing voltage (a voltage in the range of 0 to −15 V) is applied to the drain electrode through the source electrode, and the common voltage is 0 V, so that the electrophoretic particles at an associated pixel are attracted toward the pixel electrode 13*a* side. As a result, the pixel is placed in a state shown in FIG. 6(*a*) or an intermediary state between the states shown in FIGS. 6(*a*) and 6(*b*).

In the first drawing step, the above-described driving is performed, so that on the electrophoretic display panel, as shown in FIG. 1(*h*), the display is performed in the following manner.

In the reset period Fn, 1, the entire white display is performed. In the subsequent writing period Fn, 2, a picture of a house is displayed. In the subsequent reset period Fn+1, 1, the entire white display is performed. In the subsequent writing period Fn+1, 2, a picture of a flower is displayed.

Next, the drive in the above-described memory display step (2) will be described.

When the signal input from the first image creation means 2 to the controller 4 is terminated in such a state that the picture of flower is displayed at the end of the period from t0 to t1, the source voltage becomes 0 V (FIGS. 1(*b*) and 1(*e*)). As a result, the display device is not supplied with a voltage to retain the display state as it is. In other words, memory display is performed.

Next, the drive in the above-described second drawing step (3) will be described.

In the case where the pen input is effected, the X-axis position detection sheet 31*x* and the Y-axis position detection sheet 31*y* of the digitizer 31 contact each other to effect position detection of X axis and Y axis of a certain point pressed with a pen by the coordinate position detection unit. The digitizer 31 effects detection of coordinate position plural times within one frame period on the basis of sampling period formed based on the CLK signal inputted from the input terminal 320, so that the data of movement of the pen written one frame period is stored in the memory 33 in the digitizer controller 32. The pen input coordinate positioned detection data is outputted to the controller 4 on the basis of the inputted V-sync signal.

The controller 4 receives the V-sync signal and reads out the finally outputted image data stored in the graphic memory 5. The controller 4 further combines and outputs the pen input coordinate position detection data and the image data read from the graphic memory, whereby the image data overwritten with the image drawn by the pen input is displayed on the display panel.

The image data stored in the graphic memory 5 are successively read and sent to the controller 4. The controller 4 compares the coordinate position of the read image data with the pen input coordinate position sent from the memory 33. In the case where these positions are coincident with each other, the image data of the coordinate position is sent to the display panel as a darkest luminance level. In the case where these positions are not coincident with each other, the previous (original) image data is sent to the display panel as it is. The darkest luminance level is used for displaying a picture or character drawn with the pen as a black line image.

As described above, when the pen input is effected, its coordinate position is once stored in the memory 33 in the digitizer 3. This writing period in the memory is several times as short as the frame period, so that the trail of the pen is stored substantially without delay. As described above, for display, the data stored in the memory 33 in the digitizer 3 is compared with the contents of the graphic memory 5 and is directly sent to the display panel. Accordingly, the trail of the pen is continuously displayed on the display panel.

In the second drawing step, the display panel is driven only by the writing drive without the reset drive. At a pixel where the pen input is not performed, a previous (original) image is written as it is, so that it is not necessary to erase the previous image. As a result, the reset drive is not required. At the pixel where the pen input is formed, the darkest state is displayed irrespective of the previous image, so that it is not necessary to effect the reset drive.

The controller 4 performs the above described overwriting of image when the pen input coordinate position detection data and at the same time, outputs a selection signal 41 for effecting the second drawing step to be sent to the display panel 1. The display panel 1 switches the driving conditions at each pixel from those for the reset/writing drive to those only for the writing drive on the basis of the inputted selection signal 43.

Based on the selection signal 43, the serial image data inputted from the input terminals 41 and 42, and the synchronizing signal V-sync, a drive waveform with no reset signal is outputted from the scanning signal (gate) line driver 15 and the data signal (source) line driver 16. As a result, the pen-based inputted line or character is displayed on the display panel.

The period of the time t2 or later shown in FIG. 1 represents the period in which the second drawing step is performed by the display panel 1 after receiving the selection signal 43. The "area 1" represents a pixel at which overwriting is performed by effecting the pen input. FIG. 1 shows a source voltage at (b), a drain voltage at (c), and an optical response (d) at the pixel. The "area 2" represents a pixel at which overwriting is not performed since the reset drive is not performed. FIG. 1 shows a source voltage at (e), a drain voltage (f), and an optical response at (g) at the pixel.

In the "area 1", the source voltage is set to −15 V and the darkest luminance level voltage is applied to the pixel electrode, so that the resultant optical response is on the darkest level. In the "area 2", the source voltage is set to a value which equals to a voltage value of the image data finally written in the field period fn+1, 2, so that the image is reproduced. In either area, the reset drive is not performed, so that the same writing drive is performed in the former and latter of the frame period.

At the time t2 or later shown at (h) of FIG. 1, such a state that the previous image is gradually overwritten with the pen-written image as a black line image to be displayed. With each passing frame period, an additional character "A" is gradually written with time.

According to the above-described driving method, at the time of pen-based input writing, it becomes possible to effect continuous image writing without effecting reset scanning. As a result, it is possible to eliminate informity occurring at the time of effecting resetting every writing.

Incidentally, in this embodiment, in order to improve simplicity and tracking with respect to pen-based input, a frame frequency during the pen input (i.e., in the second drawing step) is two times that during an ordinary drive (i.e., in the first drawing step). However, there is no problem even if the frame frequency at the time of pen input may be constant and equal to that at the time of ordinary drive.

In this embodiment, only writing by pen input for effecting black drawing is described but it is also possible to effect pen input for effecting while input. Accordingly, by the pen input, it is possible to draw the black line or the white line. If the intended image is a two-valued output image, it is possible to effect negative/positive inversion, full-screen black rewriting and full-screen white rewriting without effecting resetting.

As the digitizer used in this embodiment, a resistance film-type device is used but it is also possible to select and use those of an ultrasonic wave-type, electromagnetic induction-type, etc., which are suitable for use in a display device or apparatus having a memory characteristic.

Second Embodiment

In this embodiment, the display apparatus is driven in the same manner as in First Embodiment except that the second drawing step (3) is performed by rewriting only a pen input area (pixel) to black and a voltage is not applied to other pixels.

Figure 9:
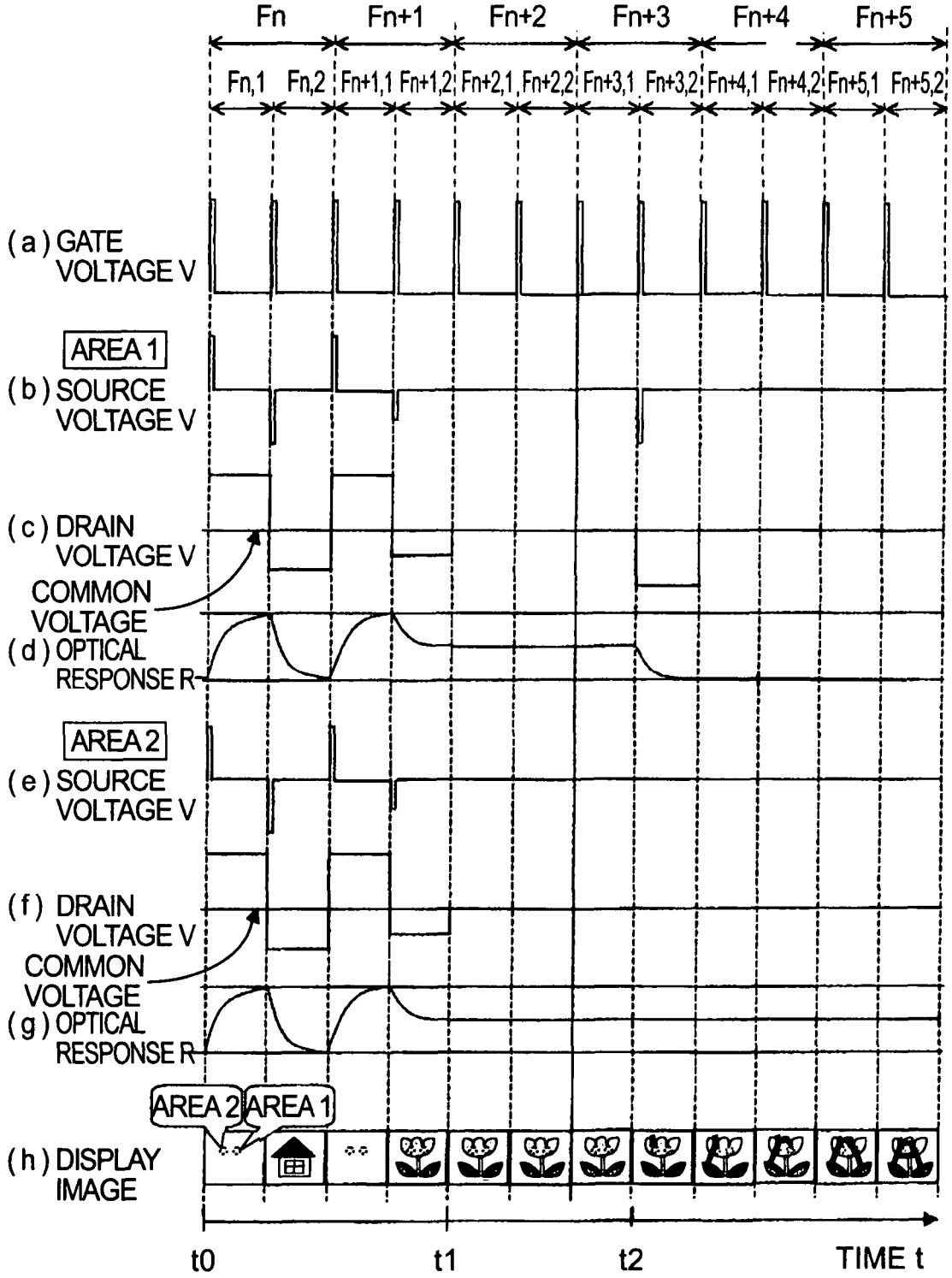
FIGS. 9, 10 and 11 are respectively a waveform diagram for explaining another embodiment of the driving method of electrophoretic display apparatus of the present invention.

FIG. 9 shows a drive waveform in this embodiment.

FIGS. 9(*a*) to (*h*) correspond to FIGS. 1(*a*) to (*h*), respectively, illustrating respective voltage pulses and optical response, wherein identical signs represent identical meanings.

Similarly as in First Embodiment, in the first drawing step (t0 to t1), the reset drive and the writing drive are performed at all the pixels. In the second drawing step (t2 or later), however, only image data such as pen input line or character data are sent to the display panel, and data of a previous (original) image as a background image are not read from the graphic memory. Accordingly, the previous image data are not subjected to image composition with the pen input image in the graphic controller. The display panel is driven without resetting in the second drawing step. To a pixel written by pen input, a voltage of the darkest luminance level is applied and at other pixels, a voltage applied thereto is kept at 0 V. No voltage is applied to the pixels to which the pen input is not effected, so that the resultant image is maintained by the memory characteristic of the display panel.

The driving method of this embodiment includes, similarly as in First Embodiment, the following three steps (1), (2) and (3).

(1) First Drawing Step

In this step, image display is performed by a signal from the first image creation means 2. This drawing step is performed in a period from a time t0 to a time t1 shown at (h) of FIG. 9. When rewriting of display is effected, resetting is performed prior to writing of a fresh image.

(2) Memory Display Step

In this step, the finally written image is retained by a memory characteristic of the display panel. This memory display step is performed in a period from the time t1 to a time t2 shown at (h). A signal input is terminated at the time t1 and the display state at the time t1 is maintained during the period from the time t1 to that time t2.

(3) Second Drawing Step

In this step, an image is drawn on the display panel with the use of the digitizer 31 and a dedicated pen (stylus) 34, or the displayed image is overwritten with a line or a character. This second drawing step is performed in a period of the time t2 or later.

Hereinbelow, the second drawing step will be described as a step for rewriting only a pixel, to which the pen input is performed, according to partial scanning. However, similarly as in First Embodiment, the second drawing step may also be performed according to full-screen scanning.

In the first drawing step, the reset drive is performed in a first field period so as to apply a drain voltage of a polarity opposite to that of a voltage for displaying a writing gradation level on the basis of a source voltage at timing of a gate signal application. In a second field period, the respective source and gate voltages are controlled so as to provide a pixel voltage necessary for writing. Accordingly, writing is performed in two field periods as one frame period.

In the second drawing step, in the display panel 1, on the basis of a selection signal inputted from the input terminal 43, driving conditions at each pixel are switched from the reset/writing drive to the writing drive. Further, on the basis of addressing data inputted from the input terminal 43 and partial rewriting image data and synchronizing signal V-sync inputted from the input terminals 41 and 42, drive waveforms are outputted from the scanning signal (gate) lien driver 15 and the data signal (source) line driver 16 to display the pen-based inputted line or character image on the display panel.

For example, when the input is performed with respect to solid black pixels 13*p*, 13*q* and 13*r*, different from an ordinary sequential scanning, a writing scanning with no reset is performed by selecting a range of scanning line along which the pixels 13*p*, 13*q* and 13*r* to be driven are present, i.e., the second gate line (electrode) g2 to the fourth gate line (electrode) g4.

In this case, respective voltages and optical response in the "area 1" are shown in FIGS. 9(*b*), 9(*c*) and 9(*d*), and those in the "area 2" are shown in FIGS. 9(*e*), 9(*f*) and 9(*g*). For example, with respect to source lines corresponding to pixels in the "area 2" to which the pen writing is not performed, e.g., the case of selecting the second gate line (electrode) g2, the input voltages to the source line (electrodes) s1 and s3 to s5 are set to 0 V as shown in FIG. 9(*e*). By doing so, it becomes possible to retain a display image in the period of the time t2 or later shown in FIG. 9(*g*) by utilizing the memory characteristic of the electrophoretic display device.

At the pixels in the "area 1" to which the pen writing is performed, the scanning line (electrode) s2 is supplied with a voltage of −15 V of the darkest luminance level at selection timing of the gate line (electrode) g2, whereby the darkest luminance display state is written.

Incidentally, in this embodiment, 0 V is inputted (applied) to non-selection pixels on the data signal driver side. However, e.g., by effecting high-impedance control for the input side or applying a drive voltage smaller than an applied voltage inputted so as to display a display image at least in the non rewriting area, the display gradation level is retained. Accordingly, these may appropriately used depending on characteristics of the devices having memory characteristic.

When the selection scanning as described above is performed, a voltage of 15 V is applied to the pixels to which the pen input writing is performed, whereby display of the darkest luminance level is effected.

At the pixel areas other than the pixels to which the pen input writing is performed, the image held by the memory characteristic of the display device is continuously displayed as shown in FIG. 9(*g*) illustrating the optical response in the "area 2".

In this embodiment, at only the pixel to which he additional data is written by the pen input without resetting, the display state is switched (FIGS. 9(*b*) to 9(*d*)). As a result, also, in this embodiment, the pen input with no inconformity can be realized in a simple structure.

Third Embodiment

In this embodiment, the electrophoretic display apparatus shown in FIGS. 3 and 4 is driven in the principally same manner as in First Embodiment through the first drawing step, the memory display step, and the second drawing step and the drive waveforms which are identical to those in First Embodiment.

The first drawing step is performed by the reset drive and the writing drive. At the time t1, the first drawing step is terminated and after the data line drive voltage becomes 0 V, the immediately previous display image is memory-displayed.

When external writing with, e.g., a dedicated pen is performed on the display picture area, the second drawing step is performed.

In this embodiment, in the case where the pen input is effected, information from the digitizer 31 is compared and combined with the image information finally stored in the memory of the first image creation means, in the same manner as in First Embodiment.

The composite image data is not sent to the display panel immediately but once sent to the graphic controller 401. The graphic controller 401 writes the image data to the VRAM. At a pixel to which rewriting is performed by pen input, image data is set to provide either one of a maximum gradation level (e.g., white) and a minimum gradation level (e.g., black).

The graphic controller 401 reaches only the full-screen image data or the image data at the changed pixel from the VRAM and transfer the image data to the read-out display panel 1. On the basis thereof, the display panel 1 effects a full-screen rewriting drive (i.e., whole rewriting drive) or a rewriting drive only at the pixels along the scanning signal line including the changed portion (pixel) (i.e., partial rewriting drive).

Incidentally, in a viewer having a pen input function, a so-called "undo" function of restoring additional information written with the pen input or the like to a previous state.

A driving method employing the "undo" operation will be described below.

As described above, the image information rewritten by the pen input is set to the maximum luminance level (e.g., white) or the minimum luminance level (e.g., black). Accordingly, the previous state at this time is limited the maximum luminance level (e.g., white) or the minimum luminance level (e.g., black). For this reason, writing for restoring the display state to the previous display state can be performed without using a reset field period for canceling the previous state.

Figure 10:
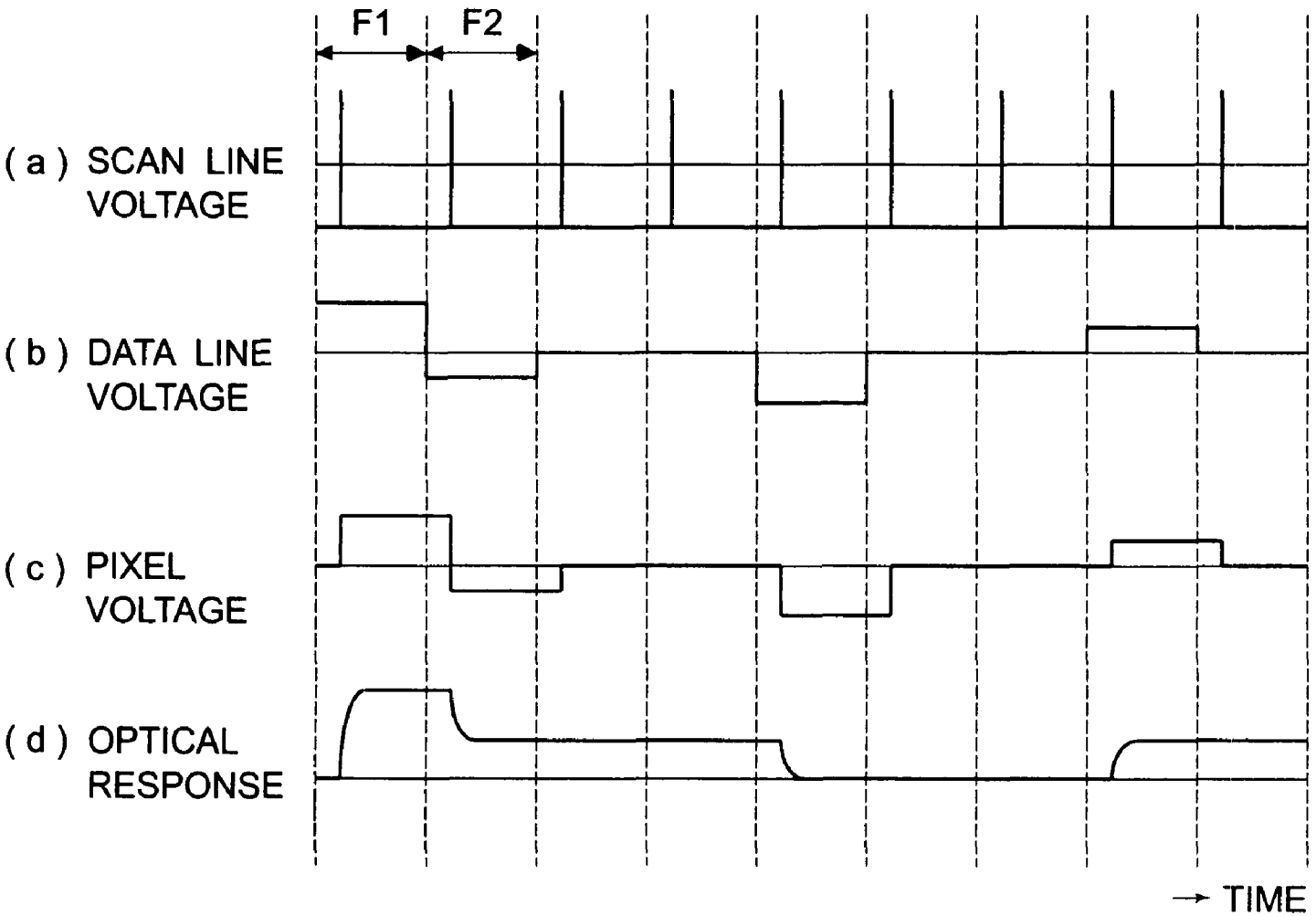

FIG. 10 shows a time chart for illustrating a drive sequence at the time of "undo" operation.

FIG. 10 shows a gate line drive pulse at (a), a source line drive pulse at (b), a drain voltage at (c), and optical response at (d), at a pixel to which the pen input is effected.

In the first drawing step, the previous image data is reset to a white level by a positive reset voltage and then written by a negative voltage pulse. After the pen input image is written in the second drawing step, the pen input pixel is placed in the minimum (darkest) luminance level. When the "undo" operation is initiated at the time t3, a positive voltage pulse is applied, whereby the state of the pixel is restored from the darkest level to the previous luminance level.

Figure 11:
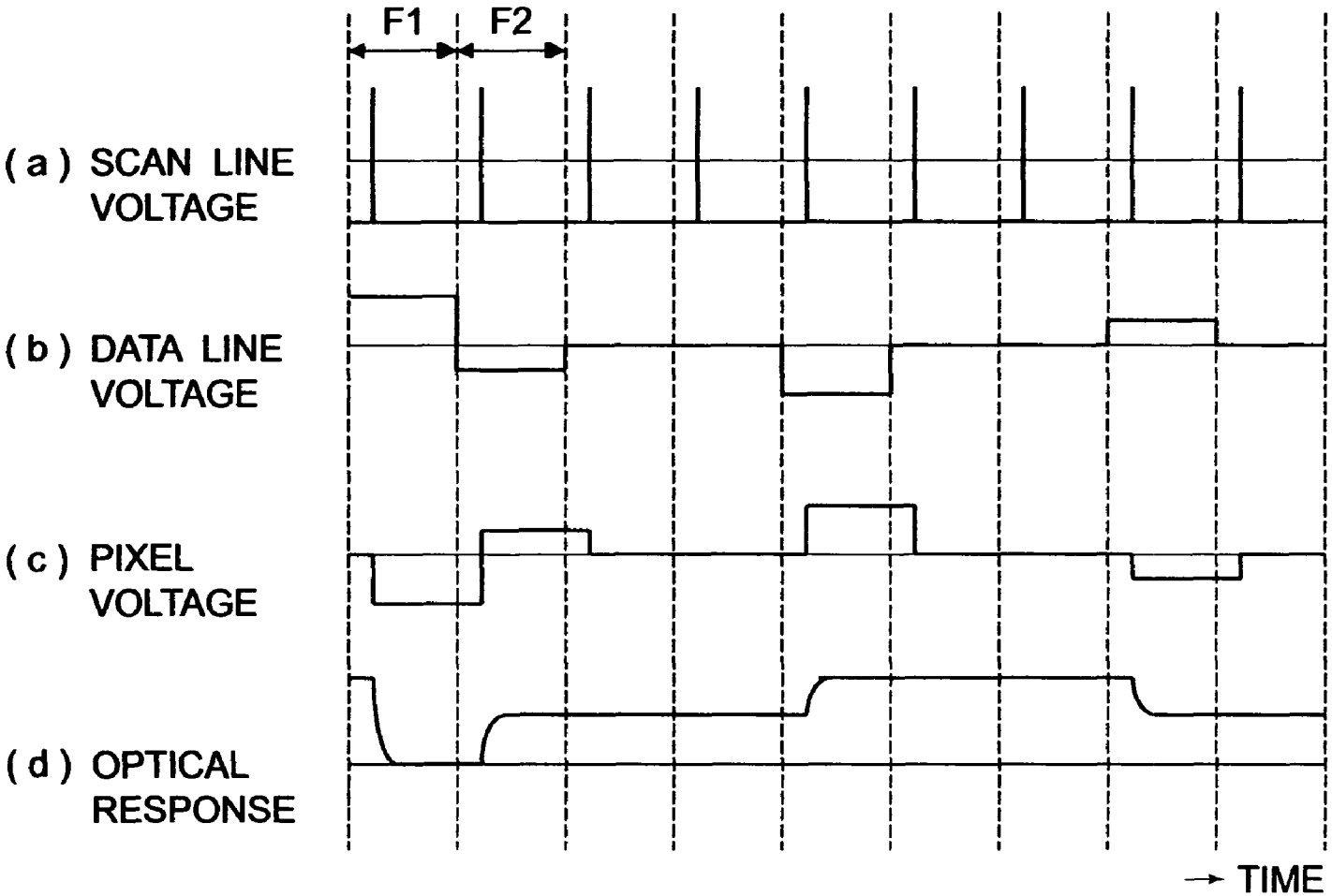

The time chart of in FIG. 10 shows the case where the previous state (pen-inputted state) before "undo" operation is of the minimum luminance level. In the case where the previous state is of the maximum luminance level, a polarity of a voltage applied for attaining a previous gradation level is different. FIG. 11 shows a time chart in the case where the previous state is of the maximum luminance level.

As described above, at the time of not only the pen input but also the "undo" operation, it is possible to perform the resetless drive.

INDUSTRIAL APPLICABILITY

As described hereinabove, according to the present invention, it is possible to provide a driving method of an electrophoretic display apparatus capable of realizing pen-based input with no inconformity by a simple structure. The electrophoretic display apparatus is applicable to displays having a pen input function, such a wearable PC and electronic note pad.

The invention claimed is:

1. A driving method of a display apparatus, comprising:

a first drawing step of displaying an image on an electrophoretic display apparatus on the basis of an image signal from first image creation means, and a second drawing step of overwriting a handwritten image on the displayed image on the basis of a signal from second image creation means in which the handwritten image is stored, wherein in said first drawing step, an image is drawn by a reset drive for resetting a previous display image and a writing drive for writing an image, and in said second drawing step, the writing drive of a substantially minimum or a substantially maximum luminance is performed in an area in which the handwritten image is written, while the image displayed in the first drawing step is maintained in areas in which the handwritten image is not written.

2. A method according to claim 1, wherein said method further comprises a third drawing step of erasing the handwritten image by leaving only the image written in said first drawing step, wherein the writing drive is performed without effecting the reset drive.

3. A method according to claim 1, wherein the display apparatus comprises electrodes to which voltages are applied from the first image creation means and the second image creation means, respectively, and the display medium for displaying an image on the basis of the voltages.

4. A method according to claim 1, wherein the display apparatus comprises a pair of substrates disposed with a predetermined spacing, an insulating liquid disposed at the spacing between the substrate, and electrophoretic particles as the display medium.

5. A driving method of an electrophoretic display panel including a plurality of electrophoretic display devices, each of which includes a pair of electrodes, an insulating liquid, and electrophoretic particles, and which effects display by applying a voltage between the pair of electrodes to move charged particles, said driving method comprising:

a first drawing step of displaying an image on an electrophoretic display panel on the basis of an image signal from first image creation means, and a second drawing step of overwriting a handwritten image on the displayed image on the basis of a signal from second image creation means in which the handwritten image is stored, wherein in said first drawing step, an image is drawn by a reset drive for resetting a previous display image and a writing drive for writing an image, which is performed by applying a voltage between the pair of electrodes, and wherein in said second drawing step, the writing drive of a substantially minimum or a substantially maximum luminance is performed in an area in which the handwritten image is written, while the image displayed in the first drawing step is maintained by applying said voltage between the pair of electrodes, in areas in which the handwritten image is not written.

6. A driving method of an electrophoretic display panel including a plurality of electrophoretic display devices, each of which includes a pair of electrodes, an insulating liquid, and electrophoretic particles, and which effects display by applying a voltage between the pair of electrodes to move charged particles, said driving method comprising:

a first drawing step of displaying an image on an electrophoretic display panel on the basis of an image signal from first image creation means, and a second drawing step of overwriting a handwritten image on the displayed image on the basis of a signal from second image creation means in which the handwritten image is stored, wherein in said first drawing step, an image is drawn by a reset drive for resetting a previous display image and a writing drive for writing an image, which is performed by applying a voltage between the pair of electrodes, and wherein in said second drawing step, the writing drive of a substantially minimum or a substantially maximum luminance is performed in an area in which the handwritten image is written, while the image displayed in the first drawing step is maintained by applying no voltage between the pair of electrodes, in areas in which the handwritten image is not written.

* * * * *